US006834606B2

(12) United States Patent
Berret et al.

(10) Patent No.: US 6,834,606 B2
(45) Date of Patent: Dec. 28, 2004

(54) PIVOTING HELM

(75) Inventors: Jean Berret, La Rochelle (FR); Olivier Racoupeau, La Rochelle (FR)

(73) Assignee: Chantiers Beneteau SA, Saint-Hilaire-de-Riez (FR)

( * ) Notice: Subject to any disclaimer, the term of this patent is extended or adjusted under 35 U.S.C. 154(b) by 0 days.

(21) Appl. No.: 10/684,368

(22) Filed: Oct. 15, 2003

(65) Prior Publication Data

US 2004/0134404 A1 Jul. 15, 2004

(30) Foreign Application Priority Data

Oct. 15, 2002 (FR) ..... 02 12826

(51) Int. Cl.[7] ..... B63H 25/00
(52) U.S. Cl. ..... 114/144 R
(58) Field of Search ..... 114/144 R, 154–161

(56) References Cited

U.S. PATENT DOCUMENTS 1,711,037 A 4/1929 Bojer
4,314,520 A 2/1982 Kosic
5,048,444 A 9/1991 Moore
5,676,081 A 10/1997 Kobelt

FOREIGN PATENT DOCUMENTS

FR 2 771 997 6/1999
JP 59/53297 3/1984

*Primary Examiner*—Ed Swinehart
(74) *Attorney, Agent, or Firm*—Young & Thompson

(57) ABSTRACT

A helm for controlling the rudder of a boat includes a base on top of which is an elongate column extending along an axis; a wheel mounted to turn on the column about a transverse axis, a rudder controller; and a device for neutralizing the rudder controller. The column is mounted to rotate relative to the base about its axis to assume a service position in which the neutralization device is deactivated and at least one rest position in which the wheel is offset angularly by at least approximately a quarter-turn relative to the service position and the neutralization device is activated.

15 Claims, 5 Drawing Sheets

PIVOTING HELM

The invention relates to seagoing and rivergoing boats and concerns a helm for controlling the rudder of a boat.

Some seagoing and rivergoing boats, in particular pleasure boats, are equipped with a helm taking the form of a column on which a wheel is mounted and turns. The wheel is intended to be operated by the helmsman, that is to say the person responsible for steering the boat, in the manner of a steering wheel.

The wheel is connected to the rudder of the boat by a transmission mechanism so that rotation of the wheel moves the rudder.

Given the force necessary to operate the rudder under water, the wheel generally has a large diameter (of the order of one meter), so that the helmsman has the benefit of the lever effect of the large wheel about its axis.

In practice, the helm is generally installed in an aft portion of the boat, such as the cockpit, provided with seats and/or intended for persons to pass through.

The helm is additionally installed therein transversely to the lengthwise direction of the boat, this arrangement being necessary so that the helmsman, when facing the wheel, is facing in the same direction as that in which the boat is moving forward.

Large diameter helms disposed transversely have a large overall size. Their overall size is particularly problematic when the boat is at rest, since the helm is no longer in use, and the movement of persons is increased, whether for embarking or disembarking passengers from the aft when stationary in port or circulation of passengers between the forward and aft ends of the boat when in motion.

Helms adapted to have their overall size minimized when the boat is stationary are known in the art, in particular helms in which the wheel is in three parts that can be folded. It appears that helms have also been proposed in which the heel is an assembly of removable angular sectors which can be superposed in the manner of a fan.

Although the above devices succeed in reducing the overall size of the helm, their great mechanical complexity makes them unreliable and difficult to manipulate.

The object of the invention is to improve existing helms, in particular by providing a simple way to reduce their overall size significantly without compromising the functions or the safety of the wheel in the service position.

To this end, and in a first aspect, the invention proposes a helm for controlling the rudder of a boat, and including:

a base on top of which is an elongate column extending along an axis, a wheel mounted to turn on an upper part of the column about a transverse axis, and rudder control means, which helm is characterized in that it further includes means for neutralizing the rudder control means and in that at least an upper part of the column is mounted to rotate relative to the base about its axis to assume a service position in which said neutralization means are deactivated and at least one rest position in which the wheel is offset angularly by at least approximately a quarter-turn relative to the service position and said neutralization means are activated.

The above kind of helm, in which the column is angularly mobile, means that the plane containing the wheel can assume different angular positions. As appropriate to the arrangement of the boat, the rest position in particular enables the wheel to be disposed parallel to the path of circulation of passengers, at the same time neutralizing the means controlling the rudder. Moving passengers therefore have to move along the wheel in the rest position, rather than circumvent it.

On the other hand, when the helm is in the service position, the rudder control means are operational and the helm looks just like a conventional helm, with no visible means of minimizing its overall size.

Moreover, the only moving parts seen from the outside of the helm are the base and the column, which turn one relative to the other. This arrangement, which is very simple to use, does not bring the user into contact with complex mechanical parts that could represent a hazard to his safety, and also is highly reliable.

To render the maneuver required of the user even simpler, said neutralization means can be controlled by the rotation of the column relative to the base.

Accordingly, when the column is pivoted to reduce its overall size, the same pivoting movement advantageously activates means for neutralizing the rudder control means, and conversely deactivates those means.

Thus a single movement of the helm is all that is necessary to change from the service position to the rest position, at the same time activating the neutralization means, or vice versa.

In one embodiment, the rudder control means are permanently interengaged with the wheel and the neutralization means include means for preventing rotation of the wheel about its transverse axis.

The effective immobilization of the rudder by immobilizing all of the transmission system between the wheel and the rudder is guaranteed by the means for preventing rotation of the wheel, which are simple to install on the above kind of helm, since the rudder control means are permanently engaged.

The means for preventing rotation of the wheel can include a toothed portion fastened to the wheel and a detent fastened to the base and disposed to come up against said toothed portion, thereby immobilizing it, when the column is in the rest position.

Thus the wheel is immobilized by a detent/toothed portion combination whose movement into mutual contact or separation is indexed to the rotation movement of the column relative to the base.

This achieves automatic and reliable immobilization of the wheel when the helm is moved to the rest position.

Alternatively, the neutralization means can include means for immobilizing a member interengaged with the rudder control means.

In this case it is a question of immobilizing a member interengaged with the rudder, independently of the transmission members situated between the wheel and said member, which makes it possible to implement the immobilization means on the transmission member most suitable for the chosen arrangement of the rudder control means.

To this end the rudder control means can include a column shaft mounted to turn in the column and driven in rotation by the wheel and said immobilization means can include a disk fastened to said column shaft.

This embodiment of the rudder control means lends itself well to the use of a disk adapted to be immobilized by means external to the transmission system.

To immobilize the disk relative to stopping means attached to the base, said disk can form a cam adapted to exert a force on the stopping means when the column is in the rest position.

The cam surface formed by the disk is adapted to move toward said stopping means as the column rotates toward the rest position, until contact occurs and the two members are finally immobilized one against the other, the cam effect being achieved laterally or axially.

This device is extremely simple since it does not use any moving part operating on the disk.

Alternatively, said immobilization means can further include brake calipers embracing the disk and adapted to immobilize it, the disk being coaxial with the column shaft in this case.

The brake calipers provide great freedom to the designer in regard to how they are activated, and they can be activated by the rotation of the column or activated autonomously.

The helm advantageously further includes a device for preventing rotation of the column, which is useful in the service position in particular.

This device prevents unwanted rotation of the column, the helm being retained in the required position despite external loads.

The device for preventing rotation of the column can include an at least partly annular slide attached to the base and a radially retractable finger on the column and cooperating with the slide, which can include a first housing adapted to receive the finger when the column is in the service position and a second housing adapted to receive the finger when the column is in the rest position.

A device of the above kind for preventing rotation of the column is not only effective in preventing rotation of the column but also assists the user by clearly indicating the rest and service positions.

A first embodiment of the rudder control means includes:

a first ring coaxial with and attached to the shaft of the wheel, a second ring mounted to turn about a transverse axis, fixed with respect to the column or the base, flexible transmission means connecting the first and second rings, and transmission means connecting the second ring to the rudder.

This is transmission by belt and flexible links, such as a chain, light and economical.

A second embodiment of the rudder control means includes:

a hydraulic pump attached to the column and operated by rotation of the shaft of the wheel, a hydraulic rudder actuator connected to said pump, and a valve in the hydraulic circuit between the pump and the actuator, adapted to close the circuit and actuated by rotation of the upper part of the column so that the valve is open when the column is in the service position and the valve is closed when the column is in the rest position.

This solution has the advantage of simplicity: a hydraulic pump connected by two pipes to a piston and cylinder constitute the rudder control means.

Furthermore, the principle of the valve being actuated directly by the rotation of the column is rugged and simple.

The same advantages can be obtained with a third embodiment of the rudder control means which includes:

a column shaft attached at a first end to a transverse lever and at a second end to a first bevel gear coaxial with said shaft, a second bevel gear attached to the shaft of the wheel, coaxial therewith, and disposed to mesh with the first bevel gear to form a concurrent axis gear, and transmission means connecting the transverse lever to the rudder.

In a second aspect, the invention proposes a boat including a cockpit equipped with a pivoting helm as previously defined, the column being disposed perpendicularly to the deck of the cockpit.

Moreover, the base can be fixed to the deck of the cockpit so that the wheel is transverse to the general direction of the boat when the column is in the service position and the angular offset terminating in the rest position can be a quarter-turn so that, in the rest position, the wheel is parallel to the general direction of the boat. A half-turn angular offset may also be advantageous for increasing the volume available for circulation in the cockpit.

Other features and advantages of the invention will become apparent in the course of the following description of a preferred embodiment of the invention, which description is given by way of nonlimiting example only and with reference to the appended drawings, in which.

Figure 1:
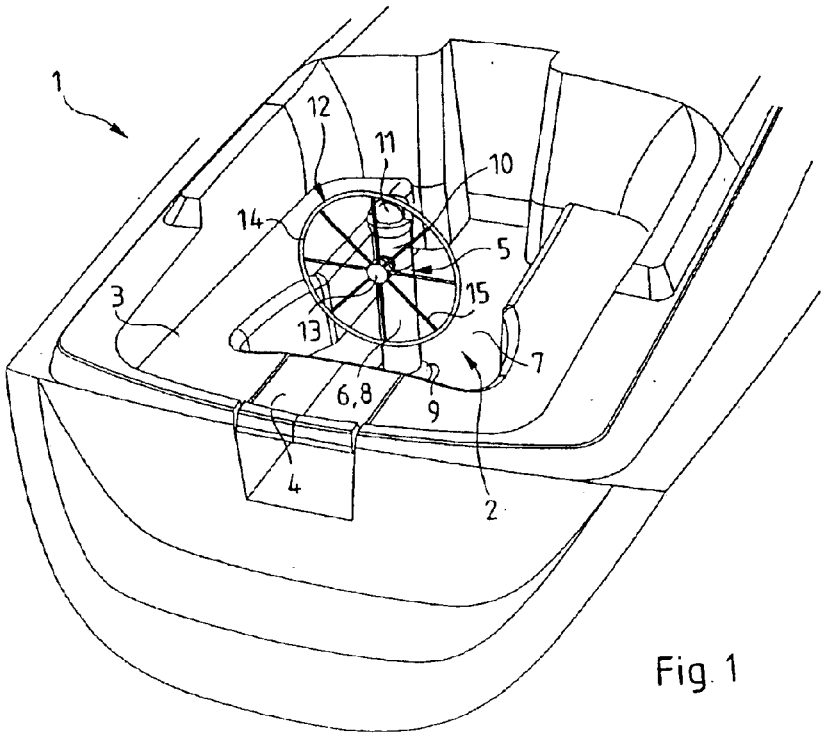
FIG. 1 is a perspective view of the aft end of a boat showing a helm according to the invention in a service position.
Figure 2:
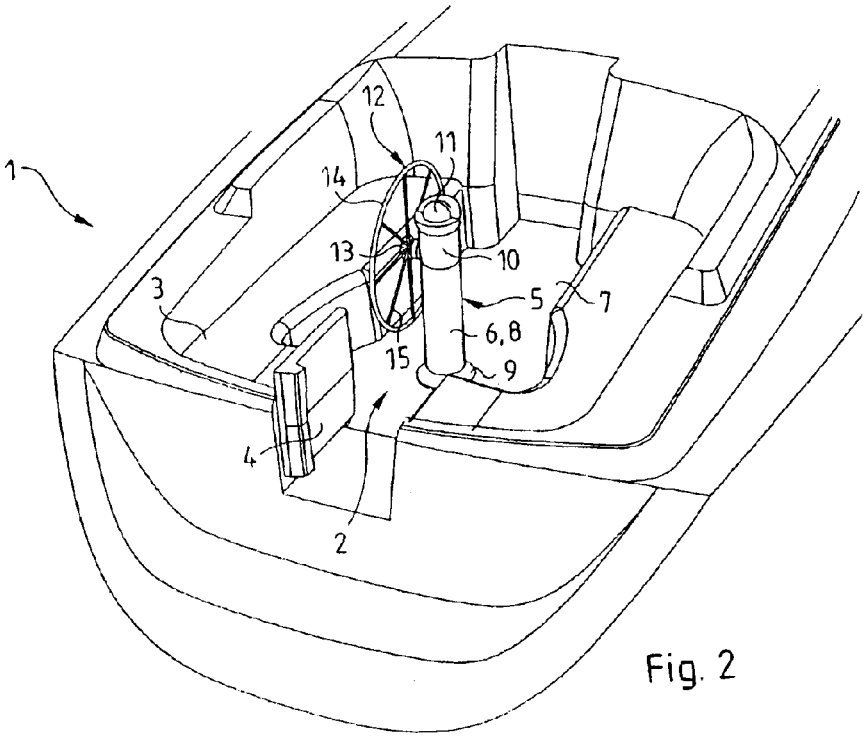
FIG. 2 is a view similar to FIG. 1 showing the helm in a rest position.

FIGS. 1 and 2 show the aft end of a boat 1 including a cockpit 2 equipped with seats 3, a folding helmsman's bench 4, and a helm 5 situated centrally in the cockpit 2.

The seats 3 are arranged around the edge of the cockpit to form a space available for passengers. Access to this space can be had from the aft end of the cockpit 2, when the folding bench 4 provides a passageway (see FIG. 2), or from the forward end of the cockpit 2.

The helm 5 disposed in this space includes a base 6 by means of which it is fixed to the deck 7 of the cockpit 2. The base 6 is a cylinder 8 attached to a flange 9 fixed to the deck 7 by screws.

The helm 5 further includes a column 10 mounted to turn on the base 6.

The column 10 takes the form of a cylinder of substantially the same diameter as the base 6 and aligned therewith.

Here the column 10 is surmounted at the end opposite the base 6 by a compass 11 which must be visible to the helmsman, since it is a navigation instrument.

A wheel 12 mounted to turn on the column 10 consists of a shaft 13 which is perpendicular to the column 10 and mounted on bearings, a ring 14 on which the helmsman rests his hands, and spokes 15 connecting the ring 14 to the shaft 13.

The internal components of the helm 5 are described next with reference to the preferred embodiment shown in FIGS. 4, 5 and 6.

The pivot between the base 6 and the column 10 is provided by an assembly of bearings. On the side opposite the flange 9, the base 6 terminates in a ring 16 axially projecting in alignment with the cylinder 8, but of smaller diameter. Rollways 17 are provided in the external walls of the ring 16.

The column 10 takes the form of a hollow cylinder that caps the base 6 and conceals said projecting ring 16, the external surfaces of the cylinder 8 of the base 6 and the column 10 being aligned with each other. The column 10 has on its internal walls, at the level of the rollways 17, imprints 18 facing the rollways 17 so that balls 19 inserted between he rollways 17 and the imprints 18 enable the column 10 to rotate relative to the base 6.

A rod 20 carrying a detent 21 is fixed to said projecting ring 16 of the base 6.

The column 10 includes two bearings 22 disposed at the same height on the column 10 and adapted to receive the shaft 13 of the wheel 12 so that the shaft 13 is perpendicular to the direction in which the column 10 extends. The shaft 13 rotates in the bearings 22 on rolling bearings or a low friction coating (not shown).

A toothed wheel 23 is force-fitted onto the shaft 13 and is therefore driven in rotation conjointly with the shaft 13. A chain 24 meshes with the toothed wheel 23 and connects it to a second toothed wheel (not shown) on the base 6, in the vicinity of the deck 7 of the cockpit 2. The toothed wheel 23 is advantageously fixed, but can equally well be mobile.

The second toothed wheel is connected to the rudder of the boat so that its rotation, driven by rotation of the wheel 12, maneuvers the rudder. Depending on the rotation direction of the wheel 12, the rudder is operated one way or the other. The device connecting the second toothed wheel and the rudder is well known in the art and is not shown in the figures.

Figure 6:
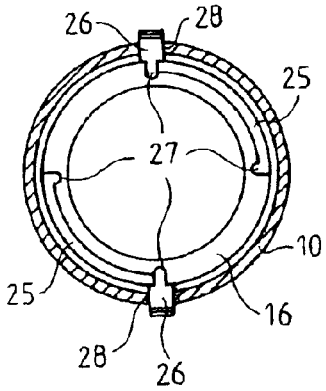
FIG. 6 is a plan view of the FIG. 4 helm in section taken along the line VI—VI.

Referring to FIG. 6, the helm 5 also includes a device for preventing rotation of the column 10. The device includes two curved slides 25 attached to the ring 16 projecting from the base 6 and two disengageable fingers 26 attached to the column 10.

The slides 25 are diametrically opposed on the ring 16 and each covers a portion of a circle corresponding to a quarter-turn angular sector. At each of their ends, the slides 25 have a housing 27 adapted to receive one of the fingers 26.

The fingers 26 are mounted in an opening 28 and are mobile radially by virtue of a sliding pivot connection with the opening 28. A spring (not shown) presses the fingers at all times against the respective slides 25.

Figure 4:
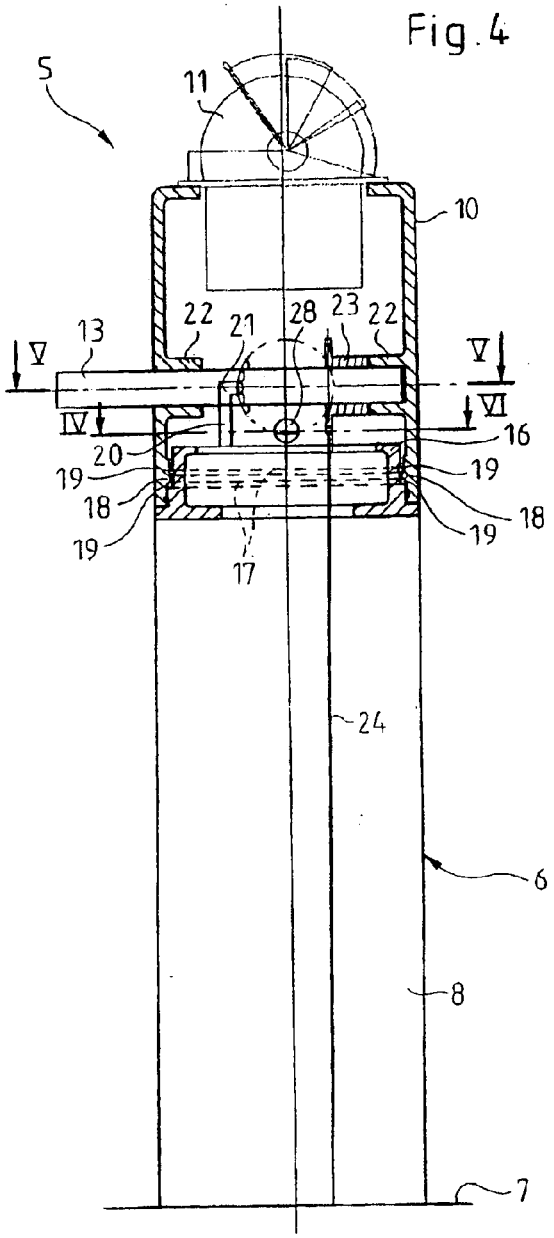
FIG. 4 is an elevation view in section of a first embodiment of a helm according to the invention, in which the wheel is not shown.

The helm 5 that has just been described can be placed in the service position shown in FIG. 4. The fingers 26 are then in their FIG. 6 position, each engaged in a respective one of the housings 27.

The helm 5 is installed in the deck 7 of the cockpit 2 so that the wheel is in the FIG. 1 position when the helm 5 is in the service position.

The toothed wheel 23 being free to turn, the helmsman can operate the wheel and thereby steer the boat.

When the boat is stationary, the helm 5 can be moved to its rest position. To this end, the fingers 26 are pulled out manually at the same time so that each is extracted from the respective housing 27 it previously occupied.

With traction still applied to the fingers 26, the column 10 must be rotated so that the fingers 26 engage in the slides 25. The traction can then be released and the rotation movement of the column 10 continued.

When the fingers 26 reach the ends of their respective slides 25, they are automatically engaged in the corresponding housing by the pressure of the spring. The helm 5 is then locked in its rest position.

The toothed wheel 23 is then in the position shown diagrammatically in FIG. 4. This position is marked R in FIG. 3. The toothed wheel comes into contact with the detent 21 which is in this position thanks to the shape of the rod 20.

The detent 21 meshing in this way with the toothed wheel 23 or the chain 24 prevents rotation of the wheel 23 and consequently neutralizes the rudder control means whilst at the same time holding the rudder in position.

Figure 5:
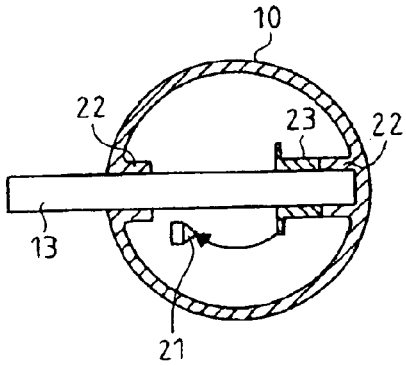
FIG. 5 is a plan view of the helm shown in FIG. 4 in section taken along the line V—V.

An arrow in FIG. 5 shows the path followed by the toothed wheel 23 on moving from the service position to the rest position.

Figure 3:
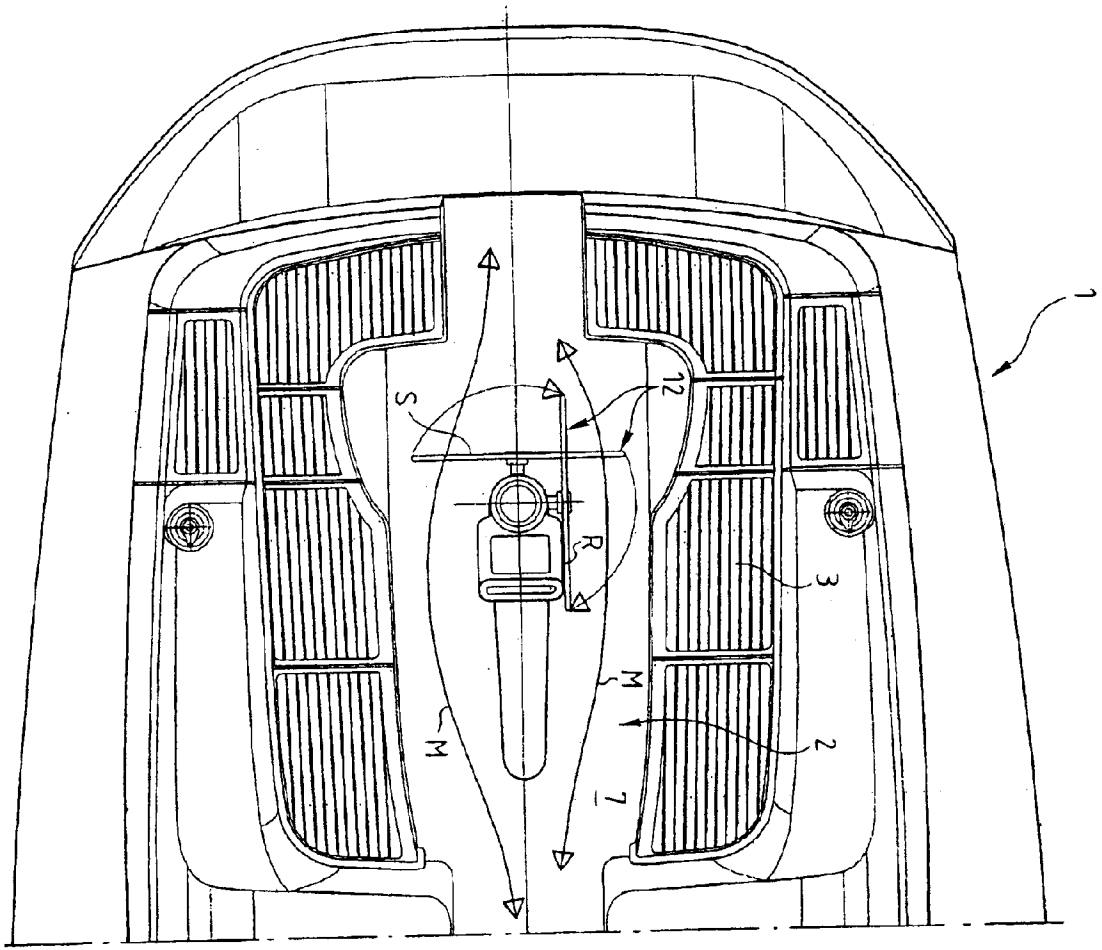
FIG. 3 is a plan view of the FIG. 1 boat, showing the helm diagrammatically in its service and rest positions.

FIG. 3 shows the cockpit 2 from above and shows the helm 5 diagrammatically in both its service position S and its rest position R. It is apparent that movements of passengers across the cockpit in the directions of the arrows M are impeded by the helm 5 in the service position (as in FIG. 1) but are facilitated by moving it to the rest position (as in FIG. 2).

In an alternative that is not shown, the slides and the detent are adapted to allow rotation in the direction opposite to that of FIG. 5.

By making the detent 21 mobile, it is possible to provide a multitude of positions of the column 10.

Two alternate embodiments of the rudder control means are described next with reference to FIGS. 7 and 8 and to FIGS. 9 and 10, respectively.

Figure 7:
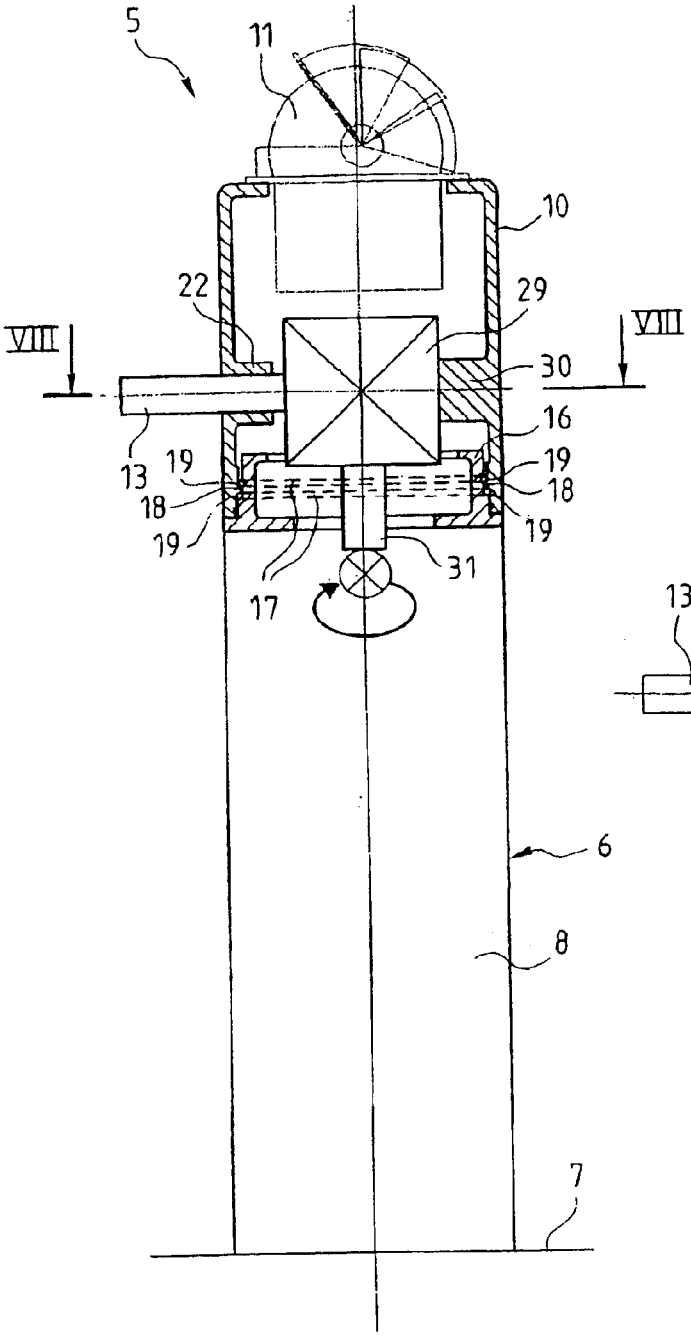
FIG. 7 is an elevation view in section of a second embodiment of a helm according to the invention, in which the wheel is not shown.
Figure 8:
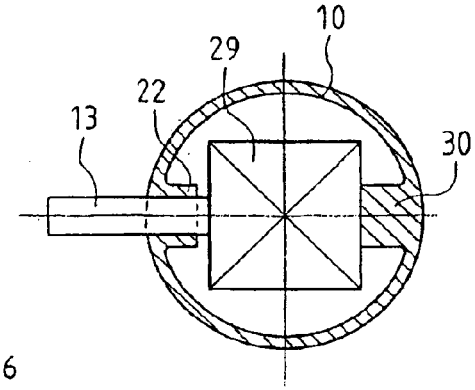
FIG. 8 is a plan view of the FIG. 7 helm in section taken along the line VIII—VIII.

FIGS. 7 and 8 show a helm 5 of similar constitution to the FIG. 4 helm, except that here the rudder control means are hydraulic.

As can be seen in FIG. 7, the shaft 13 of the wheel 12 drives rotation of a hydraulic pump 29 fixed to the column 10 by means of a support 30. The effect of rotation of the hydraulic pump 29 is to cause a fluid to flow in a circuit including an outgoing hose connected to a double-acting piston and cylinder controlling the rudder and an inlet hose also connected to the piston and cylinder and to the pump 29 (the hoses and the piston and cylinder are not shown in the figures).

Here the means for neutralizing the rudder control means are represented by a quarter-turn valve 31 on the pump 29 and coaxial with the column 10, the body of the valve 31 being attached to the pump 29 while the rotating knob that closes or opens the valve 31 is fastened to the base 6.

This configuration enables rotation of the column 10 relative to the base 6 to cause rotation of the knob of the valve 31, which is a simple way to index the opening or closure of the valve 31 to the service or rest position of the helm 5.

Figure 9:
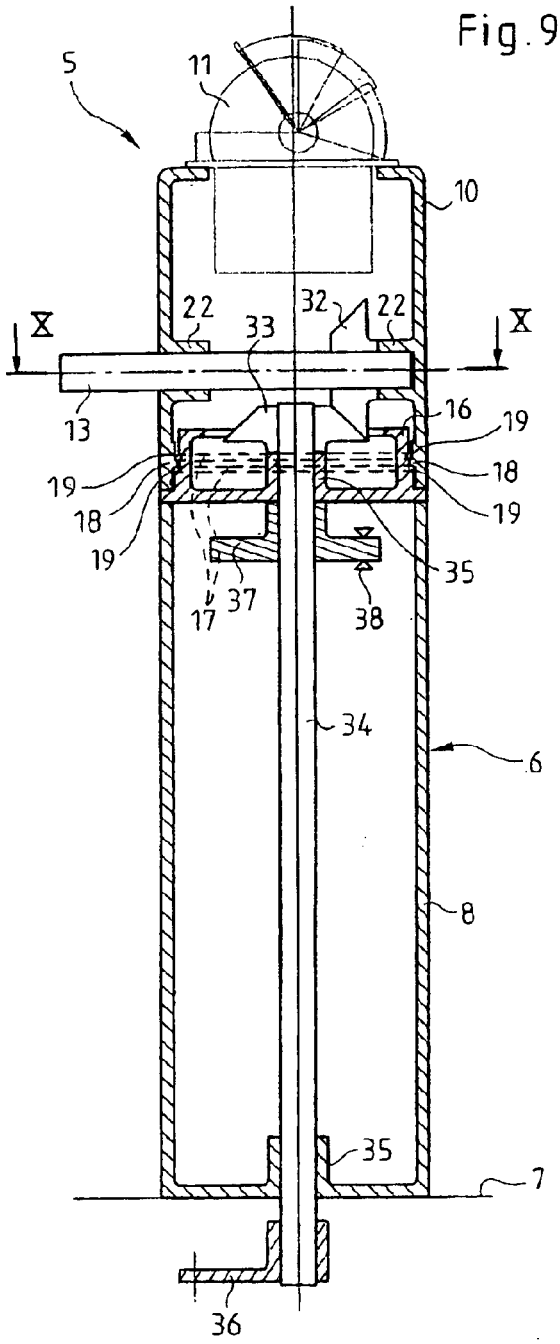
FIG. 9 is an elevation view in section of a third embodiment of a helm according to the invention, in which the wheel is not shown.
Figure 10:
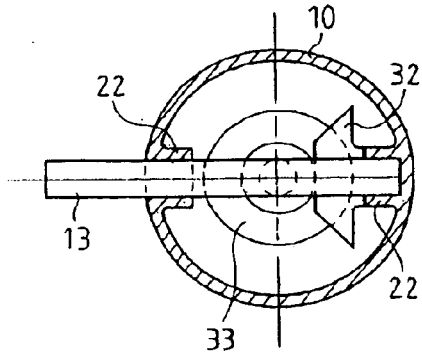
FIG. 10 is a plan view of the FIG. 9 helm in section taken along the line X—X.

The variant shown in FIGS. 9 and 10 includes a first bevel gear 32 force-fitted onto the shaft 13 of the wheel 12, which is rotatably supported by the two bearings 22, the gear 32 meshing with a second bevel gear 33 that is force-fitted onto a column shaft 34 passing through the base 6, within which it rotates in a bearing 35.

The gears 32, 33 form a concurrent axis gear for transmitting rotation movement of the shaft 13 of the wheel 12 to the column shaft 34, the latter having at its end opposite the second bevel gear 33 a transverse lever 36 controlling movement of the rudder by rotation of the column shaft 34.

Here the means for neutralizing the rudder control means are represented by a brake disk 37 attached to and coaxial with the column shaft 34 and a brake caliper 38 adapted to apply pressure to the disk to prevent it rotating.

In a variant that is not shown, the disk varies in thickness, which causes an axial cam effect. In another embodiment, the disk has on its edge a radial protrusion, which provides a lateral cam effect.

What is claimed is:

1. A helm (5) for controlling the rudder of a boat, and including:

a base (6) on top of which is an elongate column (10) extending along an axis, a wheel (12) mounted to turn on the column (10) about a transverse axis, and rudder control means controlled by the wheel, which helm is characterized in that it further includes means for neutralizing the rudder control means and in that the column (10) is mounted to rotate relative to the base (6) about its axis to assume a service position in which said neutralization means are deactivated and at least one rest position in which the wheel (12) is offset angularly by at least approximately a quarter-turn relative to the service position and said neutralization means are activated.

2. A helm according to claim 1, characterized in that said neutralization means are controlled by rotation of the column (10) relative to the base (6).

3. A helm according to claim 1, characterized in that the rudder control means are permanently interengaged with the wheel (12) and the neutralization means include means for preventing rotation of the wheel (12) about its transverse axis.

4. A helm according to claim 3, characterized in that said means for preventing rotation of the wheel (12) include a toothed portion (23) fastened to the wheel (12) and a detent (21) fastened to the base (6) and disposed to come into contact with said toothed portion (23), thereby immobilizing it, when the column (10) is in the rest position.

5. A helm according to claim 1, characterized in that the neutralization means include means for immobilizing a member interengaged with the rudder control means.

6. A helm according to claim 5, characterized in that the rudder control means include a column shaft (34) mounted to turn in the column (10) and driven in rotation by the wheel (12) and said immobilization means include a disk (37) fastened to said column shaft (34).

7. A helm according to claim 6, characterized in that said disk forms a cam adapted to exert a force on stopping means attached to the base (6) when the column (10) is in the rest position.

8. A helm according to claim 6, characterized in that said disk (37) is coaxial with the column shaft (34) and in that said immobilization means further include brake calipers (38) embracing the disk (37) and adapted to immobilize it.

9. A helm according to claim 1, characterized in that it further includes a device for preventing rotation of the column (10).

10. A helm according to claim 9, characterized in that said device for preventing rotation of the column (10) includes an at least partly annular slide (25) attached to the base (6) and a radially retractable finger (26) on the column (10) and cooperating with the slide (25), said slide (25) including a first housing (27) adapted to receive the finger (26) when the column (10) is in the service position and a second housing (27) adapted to receive the finger (26) when the column (10) is in the rest position.

11. A helm according to claim 1, characterized in that the rudder control means include:

a first ring (23) coaxial with and attached to the shaft (13) of the wheel (12), a second ring mounted to turn about a transverse axis, flexible transmission means (24) connecting the first and second rings, and transmission means connecting the second ring to the rudder.

12. A helm according to claim 1, characterized in that the rudder control means include:

a hydraulic pump (29) attached to the column (10) and operated by rotation of the shaft (13) of the wheel (12), a hydraulic rudder actuator connected to said pump (29), and a valve (31) in the hydraulic circuit between the pump (29) and the actuator, adapted to close the circuit and actuated by rotation of the column (10) so that the valve (31) is open when the column (10) is in the service position and the valve (31) is closed when the column (10) is in the rest position.

13. A helm according to claim 1, characterized in that the rudder control means include:

a column shaft (34) attached at a first end to a transverse lever (36) and at a second end to a first bevel gear (33) coaxial with said shaft (34), a second bevel gear (32) attached to the shaft (13) of the wheel (12), coaxial therewith, and disposed to mesh with the first bevel gear (33) to form a concurrent axis gear, and transmission means connecting the transverse lever (36) to the rudder.

14. A boat (1) including a cockpit (2) equipped with a pivoting helm (5) according to claim 1, the column (10) being disposed perpendicularly to the deck (7) of the cockpit (2).

15. A boat according to claim 14, characterized in that the base (10) is fixed to the deck (7) of the cockpit (2) so that the wheel (12) is transverse to the general direction of the boat (1) when the column (10) is in the service position and in that the angular offset terminating in the rest position is a quarter-turn so that, in the rest position, the wheel (12) is parallel to the general direction of the boat (1).

* * * * *